US009074317B2

(12) United States Patent
Hwang et al.

(10) Patent No.: US 9,074,317 B2
(45) Date of Patent: Jul. 7, 2015

(54) ARTIFICIAL LEATHER AND METHOD FOR MANUFACTURING THE SAME

(75) Inventors: Yeong Nam Hwang, Gumi-si (KR); Dong Tak Kim, Daegu (KR); Won Jun Kim, Gumi-si (KR)

(73) Assignee: KOLON INDUSTRIES, INC., Kwacheon-si (KR)

( * ) Notice: Subject to any disclaimer, the term of this patent is extended or adjusted under 35 U.S.C. 154(b) by 648 days.

(21) Appl. No.: 13/142,676

(22) PCT Filed: Dec. 31, 2009

(86) PCT No.: PCT/KR2009/008014

§ 371 (c)(1),
(2), (4) Date: Jun. 29, 2011

(87) PCT Pub. No.: WO2010/077111

PCT Pub. Date: Jul. 8, 2010

(65) Prior Publication Data

US 2012/0009839 A1 Jan. 12, 2012

(30) Foreign Application Priority Data

Dec. 31, 2008 (KR) ..... 10-2008-0138253

(51) Int. Cl.
*B05D 1/18* (2006.01)
*D06N 3/00* (2006.01)
*D06N 3/14* (2006.01)

(52) U.S. Cl.
CPC ..... *D06N 3/0004* (2013.01); *B05D 1/18* (2013.01); *D06N 3/14* (2013.01); *D06N 2211/28* (2013.01)

(58) Field of Classification Search
CPC ... D06N 3/0004; D06N 3/14; D06N 2211/28; B05D 1/18
USPC ..... 427/372.2, 430.1, 336, 307
See application file for complete search history.

(56) References Cited

U.S. PATENT DOCUMENTS

| | | | | |
|---|---|---|---|---|
| 3,731,352 | A * | 5/1973 | Okamoto et al. | 28/112 |
| 4,741,075 | A * | 5/1988 | Taguchi et al. | 28/104 |
| 5,277,696 | A | 1/1994 | Hagen | |
| 5,707,710 | A * | 1/1998 | Zafiroglu | 428/151 |
| 6,566,287 | B1 | 5/2003 | Mimura et al. | |
| 2004/0006857 | A1 * | 1/2004 | Romani | 28/168 |
| 2007/0066173 | A1 | 3/2007 | Teofrasti et al. | |
| 2008/0293316 | A1 * | 11/2008 | Hwang et al. | 442/60 |
| 2011/0070422 | A1 * | 3/2011 | Ammirati et al. | 428/297.4 |

FOREIGN PATENT DOCUMENTS

| | | | |
|---|---|---|---|
| CN | 1236122 | C | 1/2006 |
| EP | 0 176 181 | B1 | 4/1986 |
| EP | 1445371 | A2 | 8/2004 |
| JP | 58-126379 | A | 7/1983 |
| JP | 6197482 | A | 5/1986 |
| JP | 2002-249988 | A | 9/2002 |
| JP | 2003-20573 | A | 1/2003 |
| JP | 2004131875 | A | 4/2004 |
| JP | 2004-232126 | A | 8/2004 |
| KR | 2001-0031584 | A | 4/2001 |
| KR | 10-0332733 | B1 | 4/2002 |
| KR | 10-0337990 | B1 | 5/2002 |
| KR | 10-0530572 | B1 | 11/2005 |
| KR | 10-0546461 | B1 | 1/2006 |
| KR | 2008-0108636 | A | 12/2008 |

OTHER PUBLICATIONS

Chinese Patent Office, Chinese Office Action issued in corresponding CN Application No. 200980152786.6, dated Oct. 8, 2013.
International Searching Authority, International Search Report issued in corresponding PCT Application No. PCT/KR2009/008014, dated Jun. 28, 2012.
State Intellectual Property Office of the People'S Republic of China, Communication dated Apr. 1, 2014, issued in corresponding Chinese Application No. 200980152786.6.
Japanese Patent Office, Communication dated May 27, 2014, issued in corresponding Japanese Application No. 2011-543444.
European Patent Office, Communication dated May 12, 2014, issued in corresponding European Application No. 09836432.6.
European Patent Office, Communication dated Jul. 24, 2014, issued in counterpart Application No. 09836432.6.
Japanese Patent Office, Communication dated Feb. 17, 2015, issued in corresponding Japanese application No. 2011-543444.

* cited by examiner

*Primary Examiner* — Kirsten Jolley
(74) *Attorney, Agent, or Firm* — Sughrue Mion, PLLC

(57) ABSTRACT

Artificial leather with optimal elongation and a method for manufacturing the same is disclosed, the artificial leather comprising a non-woven fabric with micro-fibers and a polymeric elastomer impregnated into the non-woven-fiber, wherein the polymeric elastomer is 20 to 30% by weight with respect to a total weight of the artificial leather, and a density of the non-woven fabric is within the range of 0.160 to 0.250 g/cm$^3$, wherein the artificial leather can be easily used for the goods with lots of flexed regions, for example, the headliner of vehicle.

4 Claims, No Drawings

ARTIFICIAL LEATHER AND METHOD FOR MANUFACTURING THE SAME

CROSS REFERENCE TO RELATED APPLICATIONS

This application is a National Stage of International Application No. PCT/KR2009/008014 filed Dec. 31, 2009, claiming priority based on Korean Patent Application No. 10-2008-0138253 filed Dec. 31, 2008, the contents of all of which are incorporated herein by reference in their entirety.

TECHNICAL FIELD

The present invention relates to artificial leather, and more particularly, artificial leather with optimal elongation.

BACKGROUND ART

Nowadays, artificial leather, which is made by impregnating polymeric elastomer into non-woven fabric with three-dimensionally crosslinked micro-fibers, is widely used in various fields for shoes, clothes, gloves, sundry goods, Upholsteries, vehicle interior materials, and so on, because it has soft touch and unique appearance similar to those of natural leather.

There is a demand for advanced artificial leather having high functionality in flexibility, surface quality, abrasion resistance, light resistance, or elongation property according to its purpose and use. Especially, the elongation property is highly demanded when manufacturing goods with a flexed region. This is because the application of the artificial leather with the inferior elongation property to the flexed region might have lots of creases thereon during its manufacturing process.

For example, a headliner adhered to the inside roof of the vehicle is provided with lots of flexed regions according to the shape of vehicle. Thus, if the artificial leather with the inferior elongation property is used for the headliner, the creases generated during the manufacturing process may cause deterioration of quality. In this respect, the artificial leather to be used for the goods with lots of flexed regions such as the headliner has to obtain the excellent elongation property. However, if the elongation property of the artificial leather is too great, the artificial leather is excessively elongated during the manufacturing process, whereby it might have the aforementioned problem of the creases. Accordingly, there is a need for artificial leather with the optimal elongation, which is appropriate for manufacturing the goods.

DISCLOSURE

Technical Problem

Therefore, the present invention has been made in view of the above problems, and it is an object of the present invention to provide artificial leather and a method for manufacturing the same, which is capable of preventing one or more problems of the related art.

Another object of the present invention is to provide artificial leather with optimal elongation and a method for manufacturing the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Technical Solution

To achieve these objects and other advantages and in accordance with the purpose of the invention, as embodied and broadly described herein, there is provided artificial leather comprising a non-woven fabric with micro-fibers and a polymeric elastomer impregnated into the non-woven-fiber, wherein the polymeric elastomer is 20 to 30% by weight with respect to a total weight of the artificial leather, and a density of the non-woven fabric is within the range of 0.160 to 0.250 g/cm$^3$.

In another aspect of the present invention, there is provided a method for manufacturing artificial leather comprising preparing a sea-island type fiber comprising first and second polymers with the different solubility properties in solvent, wherein the first polymer corresponds to a sea component, and the second polymer corresponds to an island component; producing a non-woven fabric using the sea-island type fiber; dipping the non-woven fabric into a solution of polymeric elastomer so as to impregnate the polymeric elastomer into the non-woven fabric; and eluting and removing the first polymer corresponding to the sea component from the non-woven fabric, wherein the polymeric elastomer is 20 to 30% by weight with respect to a total weight of artificial leather.

Advantageous Effects

Artificial leather according to the present invention and a method for manufacturing the same has the following advantages.

As a concentration of polymeric elastomer is optimized in the artificial leather according to the present invention, and more particularly, a concentration of polymeric elastomer is adjusted to be within the range of 20 to 30% by weight with respect to a total weight of the artificial leather, an elongation of the artificial leather can be optimized, that is, the optimal elongation of artificial leather is realized in such a manner that the elongation at constant load at a longitudinal direction of the artificial leather is about 20 to 40%, and the elongation at constant load at a widthwise direction of the artificial leather is about 40 to 80% under the condition of 5 kg constant load. Also, a density of non-woven fabric is optimized, and more particularly, a density of non-woven fabric is adjusted to be within the range of 0.180 to 0.230 g/cm$^3$ in consideration of the aforementioned concentration of polymeric elastomer, to thereby obtain the artificial with the optimal elongation property.

The artificial leather according to the present invention can be easily used for the goods with lots of flexed regions, for example, the headliner of vehicle.

BEST MODE

Reference will now be made in detail to the preferred embodiments of the present invention, examples of which are illustrated in the accompanying drawings. Wherever possible, the same reference numbers will be used throughout the drawings to refer to the same or like parts.

Hereinafter, artificial leather according to the present invention and a method for manufacturing the same will be described with reference to the accompanying drawings.

Artificial Leather

Artificial leather is manufactured by impregnating polymeric elastomer into non-woven fabric with micro-fibers.

The polymeric elastomer may use polyurethane or polysiloxane, and more particularly, may use polycarbonatediol-based polyurethane, polyesterdiol-based polyurethane, polyetherdiol-based polyurethane, or their compounds, but not necessarily.

The polymeric elastomer is included in the artifical leather in such a manner that the polymeric elastomer is 20 to 30% by weight with respect to the total weight of the artificial leather. If the polymeric elastomer is less than 20% by weight with respect to the total weight of the artificial leather, it is difficult to realize a desired elongation in the artificial leather. Meanwhile, if the polymeric elastomer is more than 30% by weight with respect to the total weight of the artificial leather, it may cause rough and hard touch of the artificial leather, discoloration of the artificial leather, and deteriorated elongation.

The non-woven fabric may be made of nylon or polyester micro-fibers, wherein the polyester micro-fibers may be polyethyleneterephthalate (PET), polytrimethyleneterephthalate (PTT), polybutyleneterephthalate (PBT), and so on.

Preferably, a density of the non-woven fabric is within the range of 0.160 to 0.250 g/cm$^3$, but not necessarily. However, if the density of the non-woven fabric is less than 0.160 g/cm$^3$, the non-woven fabric is insufficient to reinforcement of the polymeric elastomer. In this case, since the polymeric elastomer may irregularly exist in the non-woven fabric with many pores, it may be easily broken by elongation. Meanwhile, if the density of the non-woven fabric is more than 0.250 g/cm$^3$, the density of the non-woven fabric is too large so that the elongation might be deteriorated. When the polymeric elastomer is 20 to 30% by weight with respect to the total weight of the artificial leather, it is preferable that the optimal density of the non-woven fabric be within the range of 0.180 to 0.230 g/cm$^3$, but not necessarily.

In case that the polymeric elastomer is 20 to 30% by weight with respect to the total weight of the artificial leather; and the density of the non-woven fabric is within the range of 0.160 to 0.250 g/cm$^3$, the optimal elongation is realized under the condition of 5 kg constant load in such a manner that the elongation at constant load at a length direction of the artificial leather is about 20 to 40, and the elongation at constant load at a width direction of the artificial leather is about 40 to 80%. Especially, if the density of the non-woven fabric for the artificial leather is within the range of 0.180 to 0.230 g/cm$^3$, the elongation property can be more optimized.

Preferably, a fineness of the micro-fiber of the non-woven fabric is 0.3 deniers or less, so as to realize the soft and good touch of the artificial leather.

The artificial leather according to the present invention is obtained by preparing a sea-island type fiber through a conjugate spinning process; producing the non-woven fabric using the sea-island type fiber; and making the micro-fibers by impregnating the polymer elastomer into the produced non-woven fabric and removing a sea component therefrom. In this case, the artificial leather may be obtained through steps of making the micro-fibers by removing the sea component from the non-woven fabric before impregnating the polymeric elastomer into the non-woven fabric; and impregnating the polymeric elastomer into the non-woven fabric with the micro-fibers, but not necessarily. The artificial leather may be obtained by making the micro-fibers through a spinning process; producing the non-woven fabric using the micro-fibers; and impregnating the polymeric elastomer into the non-woven fabric.

The non-woven fabric may be produced by forming a web; and needle-punching or water-jet punching the web, wherein the web may be obtained by carding and cross-lapping staples, or by spun-bonded filaments. In the method for manufacturing the artificial leather using the sea-island type fiber, the sea-island type fiber comprises first and second polymers with the different solubility properties in solvent.

The first polymer is a sea component which is dissolved in and eluted from the solvent, which may be copolymer polyester, polystyrene or polyethylene. Preferably, the first polymer is the copolymer polyester having good solubility in alkali-solvent. The copolymer polyester may be prepared by copolymerizing polyethyleneterephthalate (PET) corresponding to a main component with at least one of polyethyleneglycol; polypropyleneglycol; 1-4-cyclohexanedicarboxylic acid; 1-4-cyclohexanedimethanol; 1-4-cyclohexane dicarboxylate; 2-2-dimethyl-1,3-propanediol; 2-2-dimethyl-1,4-buthanediol; or 2,2,4-trimethyl-1,3-propanediol; adipic acid; or ester unit containing metal sulfonate, but not necessarily.

The second polymer is an island component which is insoluble in the solvent, wherein the second polymer may be nylon or polyester which remains in alkali-solvent. For example, the polyester may be polyethyleneterephthalate (PET) or polytrimethyleneterephthalate (PTT). Preferably, polytrimethyleneterephthalate (PTT) is suitable for the island component since the number of carbons in polytrimethyleneterephthalate (PTT) is between the number of carbons in polyethyleneterephthalate (PET) and the number of carbons in polybutyleneterephthalate (PBT); and polytrimethyleneterephthalate (PTT) is similar in elasticity recovery to polyamide, and also has excellent alkali-resistance.

The micro-fibers can be made from the sea-island type fiber in such a way that the first polymer corresponding to the sea component is dissolved in and eluted from the solvent, and only the second polymer corresponding to the island component remains in the solvent. Thus, in order to obtain the desired micro-fibers, it is necessary to properly adjust a concentration ratio of first polymer corresponding to the sea component to second polymer corresponding to the island component.

In more detail, the first and second polymers are included in the sea-island type fiber in such a manner that the first polymer corresponding to the sea component is about 10 to 60% by weight with respect to the total weight of the sea-island type fiber; and the second polymer corresponding to the island component is about 40 to 90% by weight with respect to the total weight of the sea-island type fiber, preferably. If the first polymer corresponding to the sea component is less than 10% by weight with respect to the total weight of the sea-island type fiber, the concentration of the second polymer corresponding to the island component is increased so that it is impossible to make the micro-fibers. Meanwhile, if the first polymer corresponding to the sea component is more than 60% by weight with respect to the total weight of the sea-island type fiber, the amount of first polymer to be eluted and removed is increased so that a production cost is increased. Also, 10 or more second polymers corresponding to the island components are separated and arranged on a cross section of the sea-island type fiber. Preferably, after eluting the first polymer corresponding to the sea component, the fineness of the second polymer corresponding to the island component is 0.3 deniers or less, thereby resulting in the soft and good touch of the micro-fibers.

A method for manufacturing the artificial leather according to one embodiment of the present invention will be explained as follows.

First, the sea-island type staple fiber is prepared.

The sea-island type staple fiber may be prepared by the staple type. In more detail, the staple can be obtained by preparing the filaments; and drawing, crimping, thermosetting and cutting the prepared filament. The filaments is obtained by preparing molten solutions of both the first polymer corresponding to the sea component and the second polymer corresponding to the island component; and applying the conjugate spinning process by extruding the prepared molten solutions from the a spinneret within the spinning block.

Preferably, the fineness of the staple fibers obtained is less than 10 deniers. If the fineness of the staple fibers is more than 10 deniers, it may cause difficulty in carrying out the carding process applied when producing the non-woven fabric using the sea-island type fiber so as to manufacture the artificial leather. More preferably, the fineness of the staple fibers is within the range of 2 to 5 deniers. Also, 10 or more second polymers corresponding to the island components are separated and arranged on a cross section of the filament. Preferably, the fineness of the second polymer corresponding to the island component is 0.3 deniers or less, so that the desired micro-fibers can be obtained after elution of the sea component, preferably.

Preferably, the length of the sea-island type staple fiber is more than 20 mm. If the length of the sea-island type staple fiber is less than 20 mm, it may cause difficulty in carrying out the carding process applied when producing the non-woven fabric to manufacture the artificial leather.

Then, the non-woven fabric is produced using the sea-island type fiber.

The non-woven fabric in the staple type is produced through steps of forming the web by carding and cross-lapping the staple fibers; and needle-punching the web. For the cross-lapping process, about 20 to 40 layers of carded staple fibers are bonded to form the web.

By controlling the steps of cross-lapping and needle-punching, the non-woven fabric is produced in such a manner that the non-woven fabric has 250 to 400 g/m$^2$ weight per unit, and 1.5 to 2.5 mm thickness. These conditions of the non-woven fabric enable to easily adjust the density of the non-woven fabric in the finally-manufacture artificial leather to the preferable range 0.180 to 0.230 g/cm$^3$. That is, in order to adjust that the density of the non-woven fabric in the finally-manufactured artificial leather to the range of 0.180 to 0.230 g/cm$^3$, a volume change of the non-woven fabric, might occur by a thermal deformation during the following processes, should be considered. Thus, it is preferable that the non-woven fabric manufactured by carding, cross-lapping, and needle-punching is within the aforementioned ranges of weight per unit and thickness.

Then, the polymeric elastomer is impregnated into the non-woven fabric.

This is to prepare a solution of the polymeric elastomer, and to dip the non-woven fabric into the prepared solution of the polymeric elastomer. This solution of the polymeric elastomer may be prepared by dissolving or dispersing polyurethane in a predetermined solvent. For example, the solution of the polymeric elastomer may be prepared by dissolving polyurethane in dimethylformamide (DMF), or dispersing polyurethane in water solvent. Instead of dissolving or dispersing the polymeric elastomer in the solvent, silicon polymeric elastomer may be directly used.

If needed for any purpose, there may be an addition to be added to the solution of the polymeric elastomer, that is, pigment, photostabilizer, antioxidant, flame retardant, softening agent, or coloring agent may be added to the solution of the polymeric elastomer.

Before dipping the non-woven fabric into the solution of the polymeric elastomer, the non-woven fabric may be padded and dried by aqueous polyvinylalcohol solution, thereby resulting in form stability.

Since the amount of polymeric elastomer to be impregnated into the non-woven fabric can be controlled by adjusting the concentration in the solution of the polymeric elastomer, and the concentration of the polymeric elastomer is 20 to 30% by weight of the finally-manufactured artificial leather, it is preferable that the concentration in the solution of the polymeric elastomer be adjusted to be within the range of 5 to 20% by weight. Under the conditions that the solution of the polymeric elastomer with the concentration of 5 to 20% by weight is maintained within the temperature range of 10 to 30° C., the non-woven fabric is dipped into the solution of the polymeric elastomer for 0.5 to 15 minutes, preferably.

After dipping the non-woven fabric into the solution of the polymeric elastomer, the solution of the polymeric elastomer into which the non-woven fabric is dipped is coagulated in a coagulating bath, and then is washed in a washing bath. At this time, if the solution of the polymeric elastomer is obtained by dissolving polyurethane in dimethylformamide (DMF) solvent, a mixture of water and a little dimethylformamide (DMF) is contained in the coagulating bath. Thus, dimethylformamide (DMF) contained in the non-woven fabric passes through the coagulating bath while the polymeric elastomer is coagulated in the coagulating bath; and polyvinylalcohol padded to the non-woven fabric and remaining dimethylformamide (DMF) are removed from the non-woven fabric by the washing process in the washing bath.

Then, the micro-fibers can be made by eluting the sea component from the non-woven fabric with the impregnated polymeric elastomer.

This process is to obtain the non-woven fabric with the micro-fibers by eluting the first polymer corresponding to the sea component through the use of alkali-solvent such as sodium hydroxide solution, and remaining only second polymer.

Then, the non-woven fabric with the micro-fibers and the impregnated polymeric elastomer is buffed and dyed through the following process, thereby manufacturing the artificial leather.

EMBODIMENTS AND COMPARATIVE EXAMPLES

Embodiment 1

A molten solution of a sea component is prepared by dissolving copolymer polyester copolymerized with a polyester unit containing 5% by mole of metal sulfonate in a main component of polyethyleneterephthalate (PET); and a molten solution of an island component is prepared by dissolving polyethyleneterephthalate (PET). A filament fibers are obtained by carrying out a conjugate spinning process using 50% by weight of the molten solution of the sea component and 50% by weight of the molten solution of the island component, wherein the filament has 3 deniers of fineness, and includes the 16 island components on its cross section. After the filament is drawn at 3.5 draw ratio, a crimping process is carried out so that the number of crimps becomes 15 per inch. After heat-setting at 130° C., the filament is cut to be 51 mm length, thereby preparing a sea-island type staple fiber.

A web is formed by carding and cross-lapping the prepared sea-island type staple fibers, and a non-woven fabric having 350 g/m$^2$ weight and 2.0 mm thickness is produced by needle-punching the formed web.

The non-woven fabric is padded with 5% by weight of aqueous polyvinylalcohol solution, and is then dried. Then, the dried non-woven fabric is submerged into a polyurethane solution with 10% by weight concentration at 25° C. for 3 minutes, wherein the polyurethane solution is obtained by dissolving polyurethane in dimethylformamide (DMF). Then, polyurethane is coagulated in 15% by weight of aqueous dimethylformamide (DMF) solution and is washed by water, and then is impregnated into the non-woven fabric.

Thereafter, the non-woven fabric with the impregnated polyurethane is treated with 5% by weight of aqueous sodium hydroxide solution, and the copolymer polyester corresponding to the sea component is eluted from the non-woven fabric, whereby the non-woven fabric with micro-fibers is made by remaining only polyethyleneterephthalate (PET) corresponding to the island component.

After the non-woven fabric with micro-fibers is buffed to have a final thickness of 0.6 mm by using #300 sand paper; the buffed non-woven fabric with micro-fibers is dyed in a high-temperature rapid dyeing machine, and is then washed and dried, and is also treated by softening and antistatic agents, thereby obtaining artificial leather.

Embodiment 2

Except that a non-woven fabric has 350 g/m$^2$ weight and 2.5 mm thickness, the second embodiment for obtaining artificial leather is identical to the aforementioned first embodiment.

Embodiment 3

Except that a non-woven fabric has 350 g/m$^2$ weight and 1.5 mm thickness, the third embodiment for obtaining artificial leather is identical to the aforementioned first embodiment.

Embodiment 4

Except that a non-woven fabric is dipped into a polyurethane solution with 13% by weight concentration at 25° C. for 5 minutes, the fourth embodiment for obtaining artificial leather is identical to the aforementioned first embodiment.

Embodiment 5

Except that a non-woven fabric is dipped into a polyurethane solution with 16% by weight concentration at 25° C. for 5 minutes, the fifth embodiment for obtaining artificial leather is identical to the aforementioned first embodiment.

Comparative Example 1

Except that a non-woven fabric is submerged into a polyurethane solution with 4% by weight concentration at 25° C. for 3 minutes, the first comparative example for obtaining artificial leather is identical to the aforementioned first embodiment.

Comparative Example 2

Except that a non-woven fabric having 200 g/m$^2$ weight and 1.5 mm thickness is dipped into a polyurethane solution with 8% by weight concentration at 25° C. for 3 minutes, the second comparative example for obtaining artificial leather is identical to the aforementioned first embodiment.

Comparative Example 3

Except that a non-woven fabric having 350 g/m$^2$ weight and 1.2 mm thickness is dipped into a polyurethane solution with 10% by weight concentration at 25° C. for 3 minutes, the second comparative example for obtaining artificial leather is identical to the aforementioned first embodiment.

Comparative Example 4

Except that a non-woven fabric is dipped into a polyurethane solution with 21% by weight concentration at 35° C. for 10 minutes, the second comparative example for obtaining artificial leather is identical to the aforementioned first embodiment.

The aforementioned embodiments and comparative examples are summarized in the following table 1.

TABLE 1

| | Non-woven fabric | | Solution of polymeric elastomer | | |
|---|---|---|---|---|---|
| | Weight (g/m$^2$) | Thickness (mm) | Concentration (% by weight) | Temperature (° C.) | Dipping time minutes) |
| Embodiment 1 | 350 | 2.0 | 10 | 25 | 3 |
| Embodiment 2 | 350 | 2.5 | 10 | 25 | 3 |
| Embodiment 3 | 350 | 1.5 | 10 | 25 | 3 |
| Embodiment 4 | 350 | 2.0 | 13 | 25 | 5 |
| Embodiment 5 | 350 | 2.0 | 16 | 25 | 5 |
| Comparative example 1 | 350 | 2.0 | 4 | 25 | 3 |
| Comparative example 2 | 200 | 1.5 | 8 | 25 | 3 |
| Comparative example 3 | 350 | 1.2 | 10 | 25 | 3 |
| Comparative example 4 | 350 | 2.0 | 21 | 35 | 10 |

EXPERIMENTAL EXAMPLES

First, an artificial leather sample of 10 cm×10 cm size is prepared, and a weight and density of the artificial leather sample is measured.

The density of the artificial leather sample is measured by measuring a thickness at 5 points of the artificial leather sample through the use of PEACOCK dial thickness gauge; measuring an average value of the measured thickness values; measuring a weight per unit by using the measured weight and area size; and dividing the measured weight per unit by the average value of the measured thickness values.

The artificial leather sample is submerged into a beaker containing 1000 ml of dimethylformamide (DMF) solution with 100% by weight concentration at 70° C. for 2 hours, and is then squeezed through the use of mangle roll, whereby a polymeric elastomer is sufficiently removed from the artificial leather sample. This process is repetitively carried out three times so as to completely remove the polymeric elastomer from the artificial leather sample.

Then, the artificial leather sample is washed several times by flowing water, and is squeezed through the use of mangle roll, whereby only non-woven fabric sheet is extracted and dried, and then a weight of the extracted non-woven fabric sheet is measured.

1) Measuring Concentration of Polymeric Elastomer

The concentration of polymeric elastomer can be calculated by the following equation 1.

$$\text{Concentration of polymeric elastomer (\%)} = \frac{(\text{weight of artificial leather sample} - \text{weight of extracted nonwoven fabric sheet})}{\text{weight of artificial leather sample}} \times 100 \quad \text{[Equation 1]}$$

2) Measuring Density of Non-woven Fabric

The density of non-woven fabric is calculated by the following equation 2.

$$\text{Density of non-woven fabric (g/cm}^3\text{)} = \text{density of artificial leather sample (g/cm}^3\text{)} \times \frac{\text{weight of extracted nonwoven fabric sheet}}{\text{weight of artificial leather sample}} \quad \text{[Equation 2]}$$

TABLE 2

| | Concentration of polymeric elastomer (% by weight) | Density of non-woven fabric ($g/cm^3$) |
|---|---|---|
| Embodiment 1 | 21 | 0.200 |
| Embodiment 2 | 23 | 0.170 |
| Embodiment 3 | 20 | 0.240 |
| Embodiment 4 | 25 | 0.205 |
| Embodiment 5 | 30 | 0.196 |
| Comparative example 1 | 18 | 0.180 |
| Comparative example 2 | 17 | 0.160 |
| Comparative example 3 | 18 | 0.263 |
| Comparative example 4 | 32 | 0.191 |

Measuring Elongation at 5 kg Constant Load

Under the condition of 5 kg constant load, an elongation for the respective artificial leather according to the aforementioned embodiments and comparative examples is measured. The elongation at 5 kg constant load of artificial leather is measured by the following method, and the result will be shown in the following table 3.

A method for measuring the elongation at 5 kg constant load is explained below.

From the artificial leather with longitudinal and widthwise directions, six samples are prepared, wherein each sample has 50 mm width and 250 mm length. First, three samples are prepared in such a manner that their lengths (that is, 250 mm length of each sample) are parallel to the longitudinal direction of the artificial leather. Then, the other three samples are prepared in such a manner that their lengths (that is, 250 mm length of each sample) are parallel to the widthwise direction of the artificial leather.

Then, a marking line of 100 mm is made in each of the six samples. After holding both ends of each sample by using two cramps positioned at an interval of about 150 mm, it is mounted on Martens fatigue tester. After 49N load (5 kgf) including a load of lower cramp is applied to each sample mounted on Martens fatigue tester, and is maintained for 10 minutes, a total distance of the marking line is measured. The elongation at constant load is calculated by the following equation.

$$\text{Elongation at 5 kg constant load (\%)} = l - 100$$

wherein l indicates the total distance of the marking line measured after 10 minutes later from starting the application of constant load. The unit of l is millimeters

TABLE 3

| | Elongation at 5 kg constant load at length direction (%) | Elongation at 5 kg constant load at width direction (%) |
|---|---|---|
| Embodiment 1 | 27 | 55 |
| Embodiment 2 | 35 | 71 |
| Embodiment 3 | 20 | 43 |
| Embodiment 4 | 28 | 58 |
| Embodiment 5 | 24 | 49 |
| Comparative example 1 | 41 | 75 |
| Comparative example 2 | 44 | 83 |
| Comparative example 3 | 15 | 35 |
| Comparative example 5 | 13 | 70 |

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for manufacturing artificial leather comprising:

preparing a sea-island type staple fiber comprising first and second polymers with the different solubility properties in solvent, wherein the first polymer corresponds to a sea component, and the second polymer corresponds to an island component;

producing a non-woven fabric using the sea-island type staple fiber;

dipping the non-woven fabric into a solution of polymeric elastomer so as to impregnate the polymeric elastomer into the non-woven fabric; and adjusting a density of the non-woven fabric into a range of 0.180 to 0.200 $g/cm^3$ by eluting and removing the first polymer corresponding to the sea component from the non-woven fabric, wherein a content of the polymeric elastomer is 20 to 25% by weight with respect to a total weight of artificial leather, wherein a concentration of the solution of polymeric elastomer is within the range of 5 to 20% by weight, wherein the step of producing the non-woven fabric comprises producing the non-woven fabric having 250 to 400 $g/m^2$ weight and 1.5 to 2.5 mm thickness, and wherein the artificial leather has an elongation at 5 kg constant load at a longitudinal direction of about 20 to 40%, and an elongation at 5 kg constant load at a widthwise direction of about 40 to 80%.

2. The method of claim 1, wherein the step of dipping the non-woven fabric into the solution of polymeric elastomer comprises dipping the non-woven fabric into the solution at 10 to 30° C. for 0.5 to 15 minutes.

3. The method of claim 1, wherein the step of eluting and removing the first polymer corresponding to the sea component from the non-woven fabric is carried out before or after impregnating the polymeric elastomer into the non-woven fabric.

4. The method of claim 1, wherein the step of preparing the sea-island type staple fiber comprises preparing the sea-island type staple fiber comprising first and second polymers, wherein the first and second polymers are included in the sea-island type staple fiber in such a manner that the first polymer corresponding to the sea component is about 10 to 60% by weight with respect to the total weight of the sea-island type fiber; and the second polymer corresponding to the island component is about 40 to 90% by weight with respect to the total weight of the sea-island staple type fiber, and wherein the first polymer is made of copolymer polyester; and the second polymer is made of polyethyleneterephthalate, polytrimethyleneterephthalate, or polybutyleneterephthalate.

* * * * *